US008066411B1

(12) United States Patent
Barton et al.

(10) Patent No.: US 8,066,411 B1
(45) Date of Patent: Nov. 29, 2011

(54) LED LIGHTING TUBE WITH ROTATIONAL END CAPS

(75) Inventors: Dan Barton, Huntington Beach, CA (US); Brad Barton, Huntington Beach, CA (US)

(73) Assignee: Reled Systems LLC, Huntington Beach, CA (US)

( * ) Notice: Subject to any disclaimer, the term of this patent is extended or adjusted under 35 U.S.C. 154(b) by 370 days.

(21) Appl. No.: 12/460,241

(22) Filed: Jul. 15, 2009

(51) Int. Cl.
*F21S 4/00* (2006.01)

(52) U.S. Cl. ..... 362/310; 362/249.02; 362/249.03; 362/249.07; 362/249.1; 362/217.04; 362/217.05

(58) Field of Classification Search ..... 362/310, 362/249.02, 249.03, 249.07, 249.1, 319, 362/219, 220, 217.05, 217.04; 439/612, 439/236

See application file for complete search history.

(56) References Cited

U.S. PATENT DOCUMENTS

| | | | |
|---|---|---|---|
| 5,526,236 | A | 6/1996 | Burnes et al. |
| 5,726,535 | A | 3/1998 | Yan |
| D477,093 | S | 7/2003 | Moriyama et al. |
| 6,796,690 | B2 | 9/2004 | Bohlander |
| D506,274 | S | 6/2005 | Moriyama et al. |
| 6,936,968 | B2 | 8/2005 | Cross et al. |
| 7,033,060 | B2 | 4/2006 | Dubuc |
| 7,052,171 | B1 | 5/2006 | Lefebvre et al. |
| 7,222,995 | B1 | 5/2007 | Bayat et al. |
| 7,311,423 | B2 | 12/2007 | Frecska et al. |
| 7,488,086 | B2 | 2/2009 | Wu et al. |
| 7,887,226 | B2 * | 2/2011 | Huang et al. ..... 362/581 |
| 2005/0265019 | A1 | 12/2005 | Sommers et al. |
| 2006/0221606 | A1 | 10/2006 | Dowling |
| 2007/0195535 | A1 | 8/2007 | Artwohl et al. |
| 2007/0247842 | A1 | 10/2007 | Zampini et al. |
| 2008/0037239 | A1 | 2/2008 | Thomas et al. |
| 2008/0151535 | A1 | 6/2008 | de Castris |
| 2008/0158858 | A1 | 7/2008 | Madireddi et al. |
| 2008/0192508 | A1 | 8/2008 | Busby |

* cited by examiner

*Primary Examiner* — Sharon Payne
(74) *Attorney, Agent, or Firm* — Cislo & Thomas, LLP

(57) ABSTRACT

An LED lighting tube having a first segment, a second segment, and a rotating connector between the segments. Each segment has an elongated cylindrical housing, an aperture in the sidewall of the cylindrical housing, a reflector centered within the aperture, a circuit board within the cylindrical housing, and a rotatable electrical coupling connected to an outer end of the cylindrical housing. The circuit board has an LED that aligns with the aperture. The rotatable electrical coupling has a limiter insert that provides a rotative stop, a collet that at least partially surrounds the limiter insert and is rotatable about the limiter insert, and an interface connector secured to the limiter insert and in electrical communication with the circuit board. The rotatable electrical coupling permits the LED lighting tube to connect to a light fixture while also permitting the cylindrical housing to rotate relative to the light fixture. The rotation of the collet about the limiter insert is limited by the rotative stop.

26 Claims, 7 Drawing Sheets

LED LIGHTING TUBE WITH ROTATIONAL END CAPS

TECHNICAL FIELD

This invention relates to LED lighting for use in existing fixtures, particularly fluorescent light fixtures.

BACKGROUND ART

Although fluorescent lights have been a staple in industrial, commercial, and residential lighting for some time, recent developments with light emitting diodes (LED) provide benefits over standard fluorescent systems. For example, LED systems feature low energy consumption, long lamp life, and reduced maintenance costs. In addition, LED give off no infrared or ultraviolet light and contained no mercury or PCBs.

Existing devices directed to replacing florescent systems with LED have several shortfalls that are addressed by the current invention. For example, the current inventive device is designed to integrate into existing standard linear fluorescent fixtures. The segments of the lamp are also able to rotate for precise aiming of the LED, and this rotation is limited to prevent over-rotation and associated problems. Moreover, the degree of rotation can be precisely measured by indications on the device, and the device can be locked into a particular position to prevent undesired further rotation.

DISCLOSURE OF INVENTION

The present invention is directed to an LED lighting tube. For ease of description, an embodiment having two segments, a first segment and a second segment, is described first. A rotating connector is between the first segment and the second segment of the LED lighting tube and permits the segments to rotate relative to each other.

Each of the first segment and the second segment has an elongated cylindrical housing with a sidewall, an aperture in the sidewall of the cylindrical housing, a reflector centered within the aperture, a circuit board within the cylindrical housing, and a rotatable electrical coupling connected to an outer end of the cylindrical housing.

The circuit board has a light emitting diode (LED). The LED aligns with the aperture such that light emitted from the LED shines out of the aperture.

The rotatable electrical coupling has a limiter insert that provides a rotative stop, a collet that at least partially surrounds the limiter insert and is rotatable about the limiter insert, and an interface connector secured to the limiter insert and in electrical communication with the circuit board. The rotatable electrical coupling permits the LED lighting tube to connect to a light fixture while also permitting the cylindrical housing to rotate relative to the light fixture. The rotation of the collet about the limiter insert is limited by the rotative stop.

In embodiments having three or more segments, there is a rotating connector between each internal segment, which does not have a rotatable electrical coupling since the internal segment need not connect to a light fixture. In such versions, the device can be configured so that each LED can rotate relative to the other LED.

In some versions of the invention, there is only one segment, which has a rotatable electric coupling at each end. In this version, there is no rotation between the individual LED.

BEST MODE FOR CARRYING OUT THE INVENTION

Figure 1:
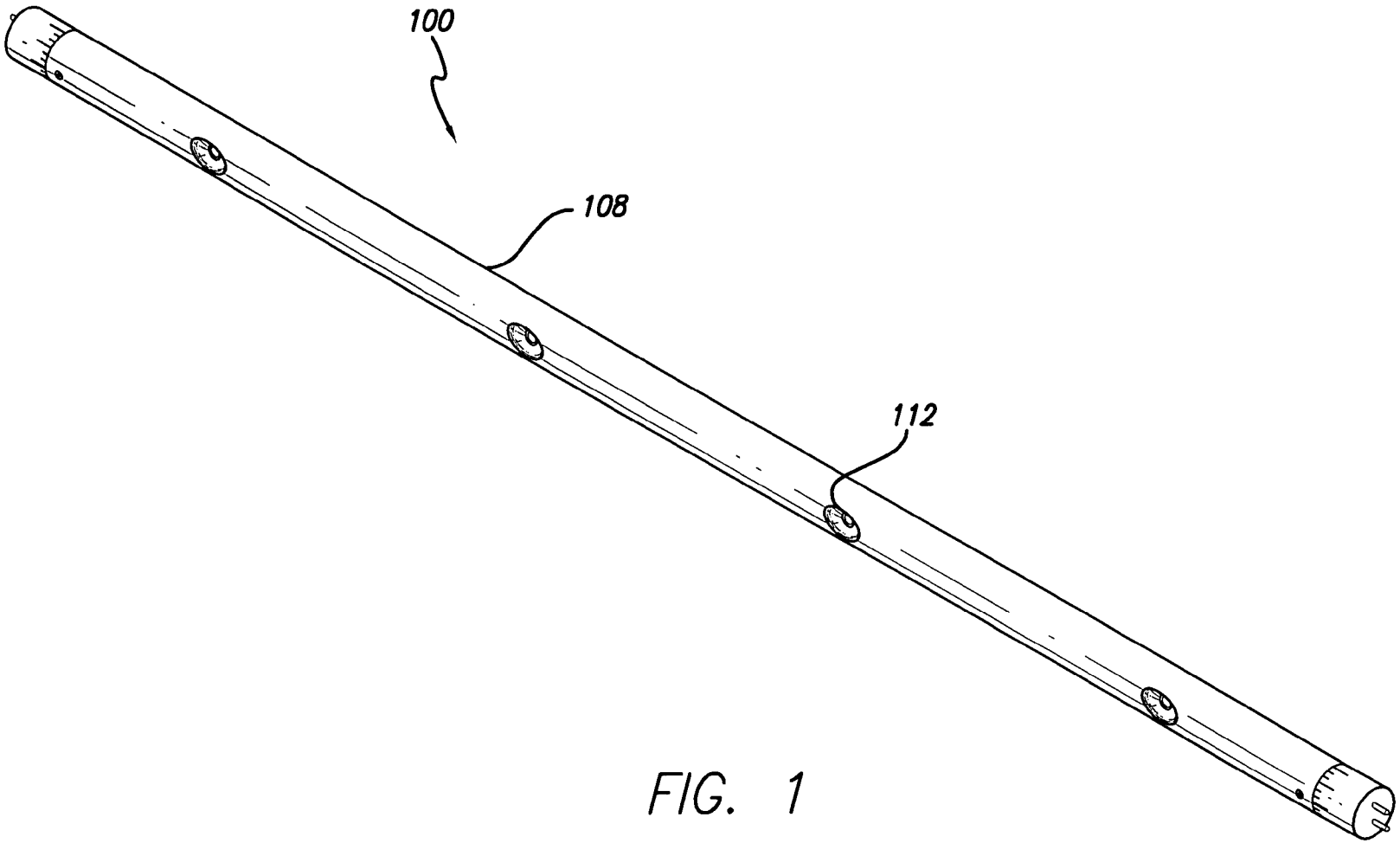
FIG. 1 is a perspective view of a version of a LED Lighting Tube with Rotational End Caps.
Figure 2:
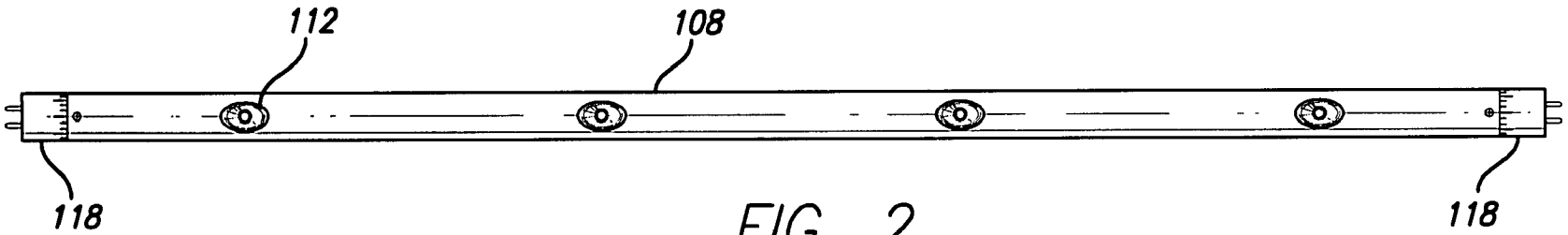
FIG. 2 is a front view of the LED Lighting Tube with Rotational End Caps shown in FIG. 1.
Figure 3:
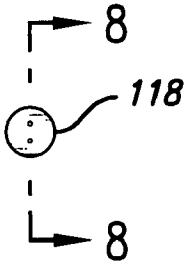
FIG. 3 is a right side elevational view of the LED Lighting Tube with Rotational End Caps shown in FIG. 1.
Figure 4:
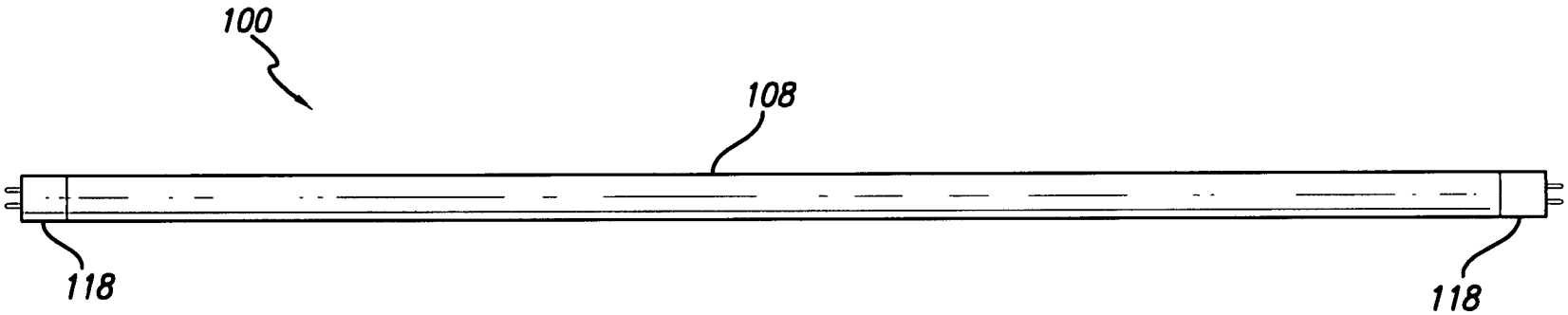
FIG. 4 is a rear view of the LED Lighting Tube with Rotational End Caps shown in FIG. 1.
Figure 5:
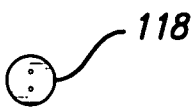
FIG. 5 is a left side elevational view of the LED Lighting Tube with Rotational End Caps shown in FIG. 1.
Figure 6:
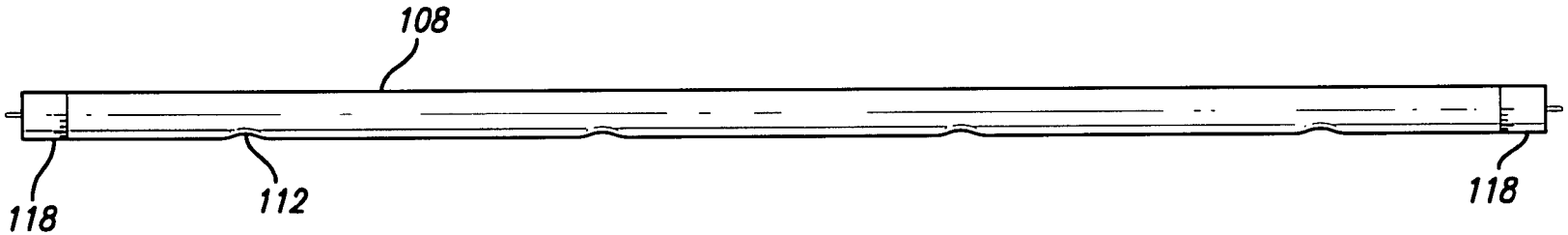
FIG. 6 is a top view of the LED Lighting Tube with Rotational End Caps shown in FIG. 1.
Figure 7:
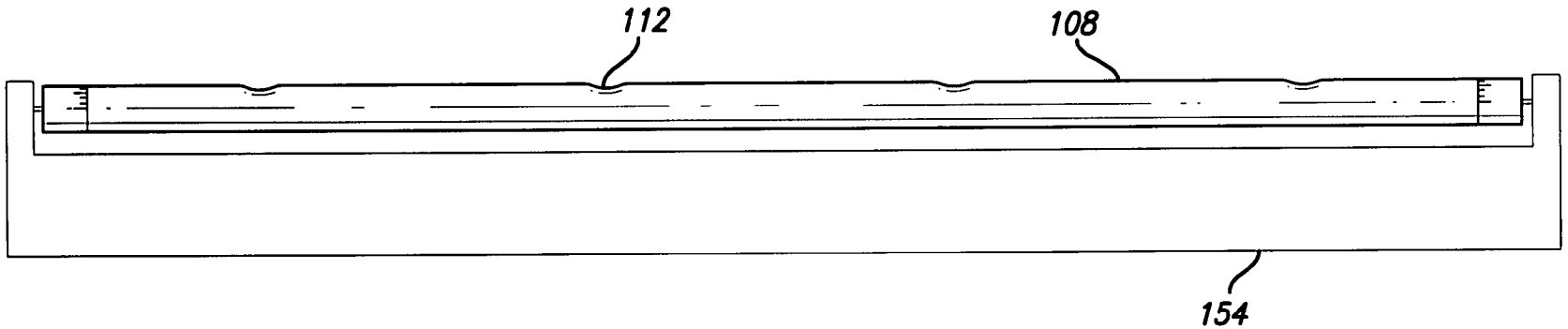
FIG. 7 is a bottom view of the LED Lighting Tube with Rotational End Caps shown in FIG. 1 and also showing a typical light fixture.
Figure 8:
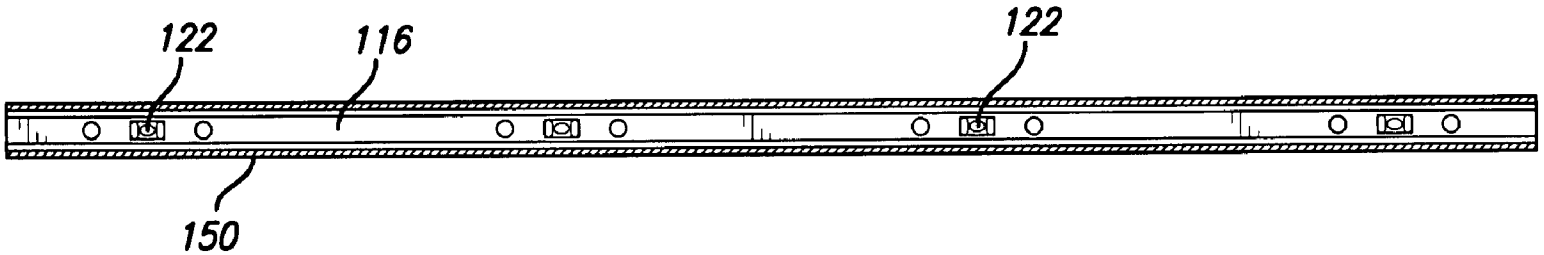
FIG. 8 is a sectional view of the LED Lighting Tube with Rotational End Caps shown in FIG. 1, the section being taken along the line 8-8 indicated in FIG. 3.
Figure 9:
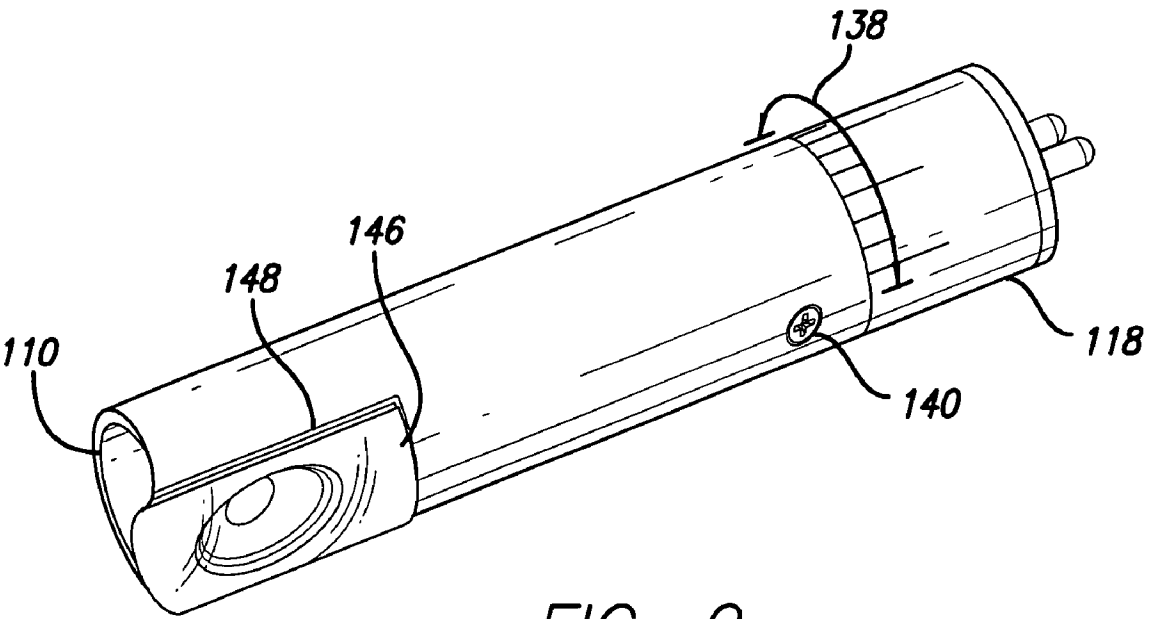
FIG. 9 is a close up of one end of the LED Lighting Tube with Rotational End Caps shown in FIG. 1.
Figure 10:
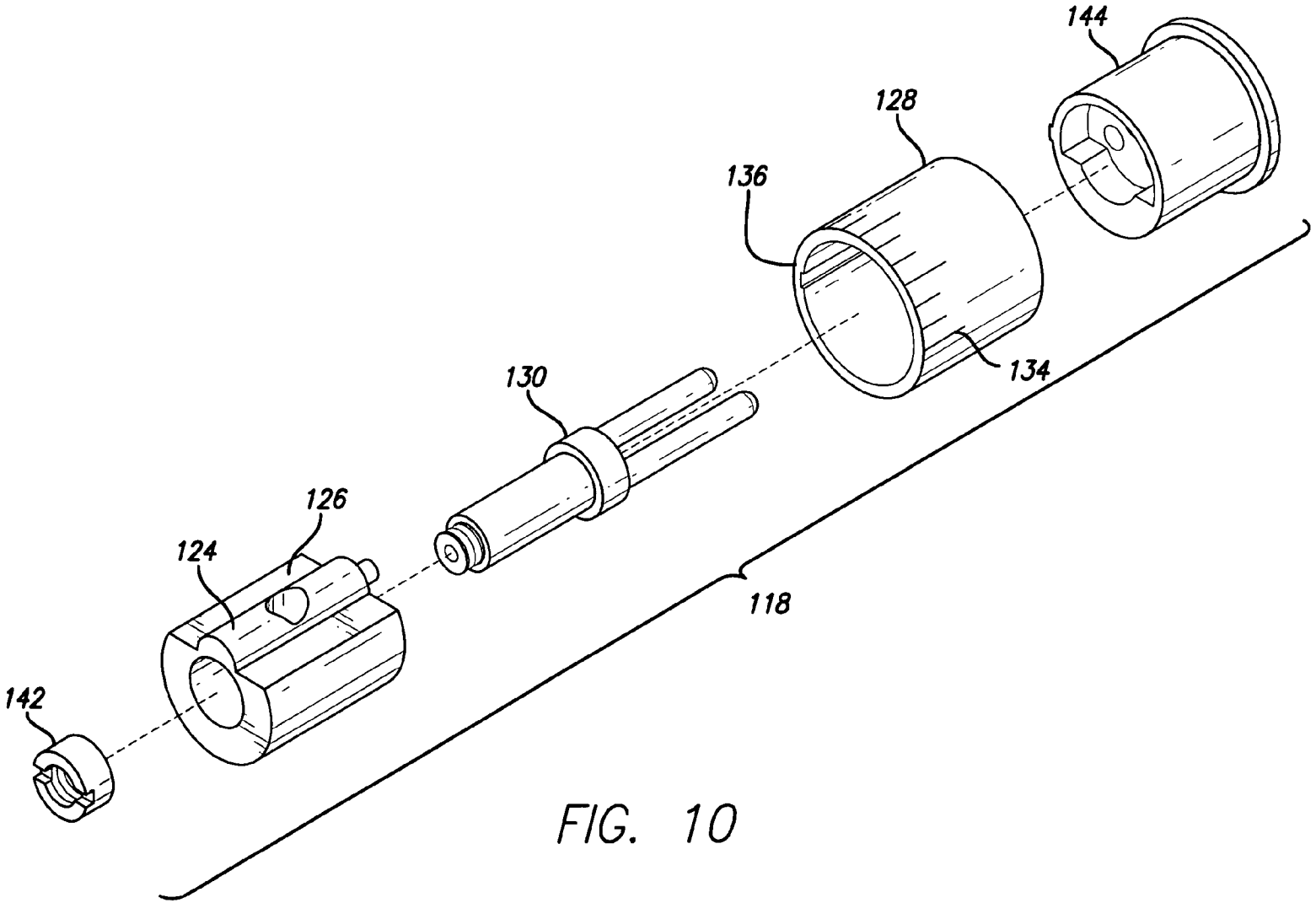
FIG. 10 is an exploded view of a rotatable electrical coupling for the LED Lighting Tube with Rotational End Caps shown in FIG. 1.
Figure 11:
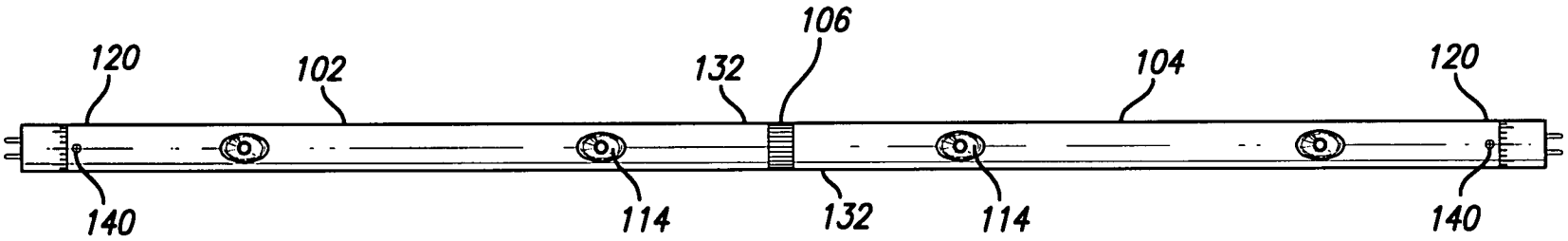
FIG. 11 is a front view of a version of the LED Lighting Tube with Rotational End Caps having two rotatable segments.
Figure 12:
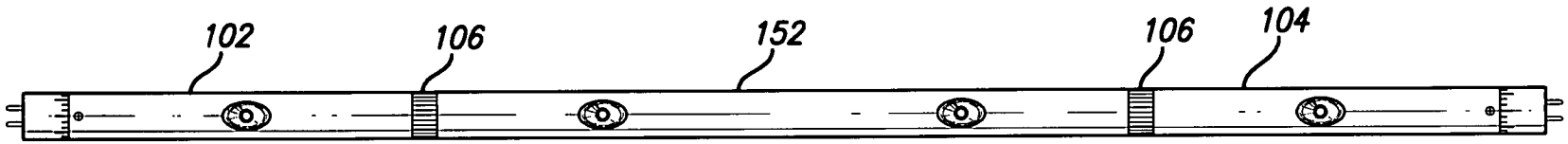
FIG. 12 is a front view of a version of the LED Lighting Tube with Rotational End Caps having more than two rotatable segments.

The detailed description set forth below in connection with the appended drawings is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Referring to the figures, the LED lighting tube 100 includes a plurality of segments. For ease of description, an embodiment having two such segments, a first segment 102 and a second segment 104, is described here. The LED lighting tube 100 also includes a rotating connector 106 between the first segment 102 and the second segment 104 of the LED lighting tube 100.

Each of the first segment 102 and the second segment 104 has an elongated cylindrical housing 108 with a sidewall 110, an aperture 112 in the sidewall 110 of the cylindrical housing 108, a reflector 114 centered within the aperture 112, a circuit board 116 within the cylindrical housing 108, and a rotatable electrical coupling 118 connected to an outer end 120 of the cylindrical housing 108.

The circuit board 116 has a light emitting diode (LED) 122. The LED 122 aligns with the aperture 112 such that light emitted from the LED 122 shines out of the aperture 112. In some embodiments, the circuit board 116 has more than one LED 122. In such embodiments, there is preferably one LED 122 for every approximately five or six inches of the cylindrical housing 108. The LED 122 are preferably high brightness diodes.

The rotatable electrical coupling 118 has a limiter insert 124 that provides a rotative stop 126, a collet 128 that at least partially surrounds the limiter insert 124 and is rotatable about the limiter insert 124, and an interface connector 130 secured to the limiter insert 124. The interface connector 130 may be a two-prong connector shown in the figures, and the interface connector 130 is in electrical communication with the circuit board 116. The rotatable electrical coupling 118 permits the LED lighting tube 100 to connect to a light fixture 154 while also permitting the cylindrical housing 108 to rotate relative to the light fixture 154. The rotation of the collet 128 about the limiter insert 124 is bounded by the rotative stop 126. This helps prevent over-rotation.

In some versions of the LED lighting tube 100, the interface connector 130 is secured to the limiter insert 124 by way of a threaded collar connector 142. The LED lighting tube 100 may also include an end plug 144 inserted into the collet 128 to support the interface connector 130 and keep debris from entering the cylindrical housing 108. The end plug 144 may be keyed to the collet 128, for example by mating slots, to prevent rotation between the two components.

The rotating connector 106 rotatively and electrically connects an inner end 132 of the first segment 102 and an inner end 132 of the second segment 104. In versions of the invention, the rotating connector 106 could be a slip ring connector, an electrical rotary joint, or a swivel connector. Rotating connectors are available from commercial sources such as Mercotac, Inc. in Carlsbad, Calif., and the Sibley Company in Haddam, Conn. The rotation of the rotating connector 106 along with the rotation of the rotatable electrical coupling 118 allows for precise aiming of the LED 122.

Preferably, the aperture 112 in the sidewall 110 of the cylindrical housing 108 is elliptical, with the major axis of the ellipse being generally parallel to the long axis of the cylindrical housing 108. The reflector 114 is preferably parabolic.

Preferably, the cylindrical housing 108 provides an efficient heat sink. In versions of the invention, the cylindrical housing 108 is aluminum, and in some embodiments of the LED lighting tube 100, the cylindrical housing 108 has a diameter of approximately ⅝ inch.

In some embodiments, the collet 128 has indications 134 along a peripheral edge 136. The indications 134 signify an angle of rotation 138 of the collet 128 in relation to the limiter insert 124. In this way, the degree of rotation can be precisely measured by the indications 134, allowing for finer calibration of rotation. Preferably, the rotation of the collet 128 about the limiter insert 124 is limited by the rotative stop 126 to have a maximum angle of rotation 138 of about 190 degrees.

In some versions of the invention, the first segment 102 and the second segment 104 also include locking means 140 for locking the rotation of the collet about the limiter insert at a desired position. In some embodiments, the locking means 140 is a set screw. As a result, the device can be locked into a particular position to prevent undesired further rotation.

In versions of the invention, the LED lighting tube 100 also has a colored lens 146 to alter the light emitted from the LED 122. In such embodiments, the LED lighting tube 100 may also include a groove 148 proximate the aperture 112. The groove 148 is shaped and dimensioned to accept the colored lens 146, and the colored lens 146 substantially covers the aperture 112. There may also be more than one colored lens 146, such as one for each LED 122. This colored lens 146 replaces color temperature LED required for specific color rendition of particular merchandise. Rather, the color output of the LED 122 is controlled by the colored lens 146. As a result, the same LED may be used for different merchandise presentations since only the colored lens 146 need be changed, for example, if necessary to produce a particular lighting effect for a merchandise display.

In some embodiments, the LED lighting tube 100 also has a semi-cylindrical frame 150 connected to the circuit board 116. The frame 150 is shaped and dimensioned to allow the frame 150 and the circuit board 116 to be slidably inserted into the cylindrical housing 108.

In embodiments having three or more segments, there is a rotating connector 106 between each internal segment 152 and between each internal segment 152 and the first segment 102 and second segment 104. Preferably, the internal segment 152 does not have a rotatable electrical coupling 118 since the internal segment 152 typically need not connect directly to a light fixture 154.

In use, the LED lighting tube 100 may be integrated into an existing standard linear fluorescent fixture, typically by also replacing the fluorescent lamp's ballast with LED driver electronics. After installation into the fixture, the various segments of the LED lighting tube 100 may be independently rotated to aim the light output from the LED 122.

While the present invention has been described with regards to particular embodiments, it is recognized that additional variations of the present invention may be devised without departing from the inventive concept.

INDUSTRIAL APPLICABILITY

This invention may be industrially applied to the development, manufacture, and use of LED lighting for use in existing fixtures, particularly fluorescent light fixtures.

What is claimed is:

1. An LED lighting tube comprising:

(a) a first segment and a second segment, each segment having:

(i) an elongated, hollow, cylindrical housing, the cylindrical housing being aluminum, the cylindrical housing having a diameter of approximately ⅝ inch and having a sidewall;

(ii) an elliptical aperture in the sidewall of the cylindrical housing;

(iii) a parabolic reflector centered within the elliptical aperture;

(iv) a circuit board within the cylindrical housing, the circuit board having a light emitting diode (LED), the LED aligning with the elliptical aperture and the parabolic reflector such that light emitted from the LED shines out of the elliptical aperture;

(v) a rotatable electrical coupling connected to an outer end of the cylindrical housing, the rotatable electrical coupling comprising (1) a limiter insert providing a rotative stop, (2) a graduated collet, the graduated collet at least partially surrounding the limiter insert, the graduated collet having indications along a peripheral edge, the graduated collet being rotatable about the limiter insert, the rotation of the graduated collet about the limiter insert being limited by the rotative stop to not exceed about 190 degrees, the indications signifying an angle of rotation of the graduated collet in relation to the limiter insert, (3) locking means for locking the rotation of the graduated collet about the limiter insert at a desired position, the locking means comprising a set screw, (4) a two-prong connector secured to the limiter insert by way of a threaded collar connector, the two-prong connector being in electrical communication with the circuit board, and (5) an end plug inserted into the graduated collet, the end plug supporting the two prongs of the two-prong connector;

(vi) a colored lens to alter the light emitted from the LED;

(vii) a groove proximate the elliptical aperture, the groove shaped and dimensioned to accept the colored lens, the colored lens substantially covering the elliptical aperture; and (viii) a semi-cylindrical frame connected to the circuit board, the frame shaped and dimensioned to allow the frame and the circuit board to be slidably inserted into the cylindrical housing; and (b) a rotating connector between the first segment and the second segment of the LED lighting tube, the rotating connector rotatively and electrically connecting an inner end of the first segment and an inner end of the second segment.

2. An LED lighting tube comprising:

(a) a first segment and a second segment, each segment having:

(i) an elongated cylindrical housing, the cylindrical housing having a sidewall;

(ii) an aperture in the sidewall of the cylindrical housing;

(iii) a reflector centered within the aperture;

(iv) a circuit board within the cylindrical housing, the circuit board having a light emitting diode (LED), the LED aligning with the aperture such that light emitted from the LED shines out of the aperture;

(v) a rotatable electrical coupling connected to an outer end of the cylindrical housing, the rotatable electrical coupling comprising (1) a limiter insert providing a rotative stop, (2) a collet, the collet at least partially surrounding the limiter insert, the collet being rotatable about the limiter insert, the rotation of the collet about the limiter insert being limited by the rotative stop, and (3) an interface connector secured to the limiter insert, the interface connector being in electrical communication with the circuit board; and (b) a rotating connector between the first segment and the second segment of the LED lighting tube, the rotating connector rotatively and electrically connecting an inner end of the first segment and an inner end of the second segment.

3. The LED lighting tube of claim 2, the cylindrical housing being aluminum.

4. The LED lighting tube of claim 2, the cylindrical housing having a diameter of approximately ⅝ inch.

5. The LED lighting tube of claim 2, the aperture in the sidewall of the cylindrical housing being elliptical.

6. The LED lighting tube of claim 2, the reflector being parabolic.

7. The LED lighting tube of claim 2, the LED also aligning with the reflector.

8. The LED lighting tube of claim 2, the collet having indications along a peripheral edge, the indications signifying an angle of rotation of the collet in relation to the limiter insert.

9. The LED lighting tube of claim 2, the rotation of the collet about the limiter insert being limited by the rotative stop to not exceed about 190 degrees.

10. The LED lighting tube of claim 2, each segment further comprising locking means for locking the rotation of the collet about the limiter insert at a desired position.

11. The LED lighting tube of claim 10, the locking means comprising a set screw.

12. The LED lighting tube of claim 2, the interface connector being a two-prong connector.

13. The LED lighting tube of claim 2, the interface connector being secured to the limiter insert by way of a threaded collar connector.

14. The LED lighting tube of claim 2 further comprising an end plug inserted into the collet, the end plug supporting the interface connector.

15. The LED lighting tube of claim 2 further comprising a colored lens connected to the cylindrical housing to alter the light emitted from the LED.

16. The LED lighting tube of claim 15 further comprising a groove proximate the aperture, the groove shaped and dimensioned to accept the colored lens, the colored lens substantially covering the aperture.

17. The LED lighting tube of claim 2 further comprising a semi-cylindrical frame connected to the circuit board, the frame shaped and dimensioned to allow the frame and the circuit board to be slidably inserted into the cylindrical housing.

18. The LED lighting tube of claim 2, the rotating connector comprising a slip ring connector.

19. The LED lighting tube of claim 2, the rotating connector comprising an electrical rotary joint.

20. The LED lighting tube of claim 2, the rotating connector comprising a swivel connector.

21. An LED lighting tube comprising:

(a) a first outer segment, a second outer segment, and an inner segment, each having:

(i) an elongated cylindrical housing, the cylindrical housing having a sidewall;

(ii) an aperture in the sidewall of the cylindrical housing;

(iii) a reflector centered within the aperture; and (iv) a circuit board within the cylindrical housing, the circuit board having a light emitting diode (LED), the LED aligning with the aperture such that light emitted from the LED shines out of the aperture;

(b) each of the first outer segment and a second outer segment further comprising a rotatable electrical coupling connected to an outer end of the cylindrical housing, the rotatable electrical coupling comprising (1) a limiter insert providing a rotative stop, (2) a collet, the collet at least partially surrounding the limiter insert, the collet being rotatable about the limiter insert, the rotation of the collet about the limiter insert being limited by the rotative stop, and (3) an interface connector secured to the limiter insert, the interface connector being in electrical communication with the circuit board;

(c) a first rotating connector between the first segment and the inner segment, the first rotating connector rotatively and electrically connecting an inner end of the first segment and a first mating end of the inner segment; and (d) a second rotating connector between the second segment and the inner segment, the second rotating connector rotatively and electrically connecting an inner end of the second segment and a second mating end of the inner segment.

22. An LED lighting tube comprising:

(a) an elongated cylindrical housing, the cylindrical housing having a sidewall;

(b) an elliptical aperture in the sidewall of the cylindrical housing;

(c) a parabolic reflector centered within the aperture;

(d) a circuit board within the cylindrical housing, the circuit board having a light emitting diode (LED), the LED aligning with the aperture and the parabolic reflector such that light emitted from the LED shines out of the aperture; and (e) a rotatable electrical coupling connected to an outer end of the cylindrical housing, the rotatable electrical coupling comprising (1) a limiter insert providing a rotative stop, (2) a collet, the collet at least partially surrounding the limiter insert, the collet being rotatable about the limiter insert, the rotation of the collet about the limiter insert being limited by the rotative stop, and (3) an interface connector secured to the limiter insert, the interface connector being in electrical communication with the circuit board.

23. The LED lighting tube of claim 22, the collet having indications along a peripheral edge, the indications signifying an angle of rotation of the collet in relation to the limiter insert.

24. The LED lighting tube of claim 22, the rotation of the collet about the limiter insert being limited by the rotative stop to not exceed about 190 degrees.

25. The LED lighting tube of claim 22 further comprising locking means for locking the rotation of the collet about the limiter insert at a desired position.

26. The LED lighting tube of claim 22 further comprising a colored lens connected to the cylindrical housing to alter the light emitted from the LED and a groove proximate the elliptical aperture, the groove shaped and dimensioned to accept the colored lens, the colored lens substantially covering the elliptical aperture.

* * * * *